US011192014B2

(12) United States Patent
Spedaliere

(10) Patent No.: US 11,192,014 B2
(45) Date of Patent: Dec. 7, 2021

(54) SYSTEM FOR EXPELLING AND COLLECTING BALLS AND RELATED OPERATING PROCESS

(71) Applicant: Giuseppe Spedaliere, Naples (IT)

(72) Inventor: Giuseppe Spedaliere, Naples (IT)

( * ) Notice: Subject to any disclaimer, the term of this patent is extended or adjusted under 35 U.S.C. 154(b) by 214 days.

(21) Appl. No.: 16/618,987

(22) PCT Filed: May 18, 2018

(86) PCT No.: PCT/IT2018/000075
§ 371 (c)(1),
(2) Date: Dec. 3, 2019

(87) PCT Pub. No.: WO2018/225103
PCT Pub. Date: Dec. 13, 2018

(65) Prior Publication Data

US 2021/0121760 A1 Apr. 29, 2021

(30) Foreign Application Priority Data

Jun. 5, 2017 (IT) ..... 102017000060992

(51) Int. Cl.
*A63B 69/40* (2006.01)
*A63B 67/04* (2006.01)
(Continued)

(52) U.S. Cl.
CPC ..... *A63B 69/406* (2013.01); *A63B 67/045* (2013.01); *A63B 71/0622* (2013.01);
(Continued)

(58) Field of Classification Search
CPC . A63B 69/406; A63B 67/045; A63B 71/0622; A63B 2102/02; A63B 2102/16;
(Continued)

(56) References Cited

U.S. PATENT DOCUMENTS 3,766,901 A * 10/1973 Cleary ..... A63B 69/406 124/78
4,883,272 A * 11/1989 Lay ..... A63B 63/00 473/436

(Continued)

FOREIGN PATENT DOCUMENTS

CN 2320292 Y 5/1999
CN 2899874 Y 5/2007

(Continued)

OTHER PUBLICATIONS

Written Opinion dated Dec. 13, 2018 in PCT/IT2018/000075 (6 pages).

(Continued)

*Primary Examiner* — Jeffrey S Vanderveen
(74) *Attorney, Agent, or Firm* — Nelson Mullins Riley & Scarborough LLP; Thomas J. Engellenner; Reza Mollaaghababa

(57) ABSTRACT

An omnidirectional system (1) is described, for expelling and collecting balls, adapted to reproduce a real playing and/or training dynamics, such system (1) being equipped with at least one closing element (8) connected to at least one expelling device (2) of the system (1) arranged orthogonal to the expelling device (2) when expelling at least one ball from the system (1), the ball bouncing on an upper surface of the closing element (8) going towards at least one user; and with at least one net element (7) of at least one collecting element (3) of the system (1).

6 Claims, 2 Drawing Sheets

(51) Int. Cl.

| | |
|---|---|
| ***A63B 71/06*** | (2006.01) |
| ***A63B 102/02*** | (2015.01) |
| ***A63B 102/16*** | (2015.01) |
| ***A63B 63/08*** | (2006.01) |
| ***A63B 63/00*** | (2006.01) |

(52) U.S. Cl.
CPC ..... *A63B 63/083* (2013.01); *A63B 2063/001* (2013.01); *A63B 2071/0683* (2013.01); *A63B 2102/02* (2015.10); *A63B 2102/16* (2015.10); *A63B 2220/20* (2013.01); *A63B 2220/34* (2013.01); *A63B 2220/801* (2013.01); *A63B 2225/093* (2013.01); *A63B 2225/50* (2013.01)

(58) Field of Classification Search
CPC ..... A63B 63/083; A63B 2063/001; A63B 2071/0683; A63B 2220/20; A63B 2220/34; A63B 2220/801; A63B 2225/093; A63B 2225/50; A63B 2071/025; A63B 2071/0675; A63B 2220/30; A63B 2225/09; A63B 2243/0037
See application file for complete search history.

(56) References Cited

U.S. PATENT DOCUMENTS

| | | | | |
|---|---|---|---|---|
| 5,125,653 | A * | 6/1992 | Kovacs | A63B 69/406 124/78 |
| 5,776,018 | A * | 7/1998 | Simpson | A63B 24/0021 473/433 |
| 5,897,445 | A * | 4/1999 | Sanders | A63B 24/0003 473/421 |
| 6,186,132 | B1 * | 2/2001 | Ko | A63B 69/40 124/6 |
| 7,066,845 | B2 * | 6/2006 | Joseph | A63B 69/0071 124/78 |
| 9,555,307 | B1 * | 1/2017 | Lewis | A63B 47/02 |
| 9,579,554 | B1 | 8/2017 | Boehner | |
| 10,596,436 | B1 * | 3/2020 | Campbell | A63B 69/407 |
| 10,870,045 | B2 * | 12/2020 | Joseph | G01S 13/88 |
| 2002/0005614 | A1 * | 1/2002 | Krull | A63B 65/12 273/355 |
| 2007/0149326 | A1 * | 6/2007 | York | A63B 69/406 473/438 |
| 2011/0281672 | A1 * | 11/2011 | Campbell | A63B 69/0071 473/433 |
| 2016/0082340 | A1 * | 3/2016 | Adams | A63B 69/0071 473/433 |
| 2017/0326414 | A1 * | 11/2017 | York | A63B 63/08 |

FOREIGN PATENT DOCUMENTS

| | | | |
|---|---|---|---|
| CN | 203043492 | Y | 7/2013 |
| DE | 2219177 | A1 | 10/1973 |
| GB | 857260 | A | 4/1959 |
| JP | S5711667 | A | 1/1982 |
| JP | H03111067 | A | 5/1991 |
| WO | 199408666 | A1 | 4/1994 |
| WO | 2011010765 | A1 | 1/2011 |
| WO | 2016174484 | A1 | 11/2016 |

OTHER PUBLICATIONS

International Search Report dated Dec. 13, 2018 in PCT/IT2018/000075 (3 pages).
International Preliminary Report on Patentability dated Dec. 10, 2019 in PCT/IT2018/000075 (7 pages).

* cited by examiner

SYSTEM FOR EXPELLING AND COLLECTING BALLS AND RELATED OPERATING PROCESS

CROSS-REFERENCE TO RELATED APPLICATIONS

This Application is a U.S. National Phase Application of International Application No. PCT/IT2018/000075, filed on May 18, 2018, which claims priority to and the benefit of Italian Application No. 102017000060992, filed on Jun. 5, 2017, the entire teachings of which are incorporated herein by reference.

BACKGROUND OF THE INVENTION

1) Field of the Invention

The present invention refers to a system for expelling and collecting balls, in particular within the field of activities with rackets and sports training.

2) Background Art

Ball-launching machines are known in the art, and are used with the games of tennis, table tennis or basket.

Known ball-launching machines have a propelling system with two, independently actuated rollers, which allow expelling a ball at a speed of 150 km/h and affecting the rotation effect which can extend on a wide field. In particular, a ball-launching machine is known, which is equipped with an internal oscillation system with random launch of the ball, which makes it more stable and accurate, and equipped with black-colored launching wheels, making the shot unforeseeable and similar to the one of a real player.

Known ball-launching machines are also equipped with a control panel, which allows regulating, manually or with a remote control by a user, a few parameters, such as ball speed, ball rotation effects, and time interval between launch of a ball and following launch.

Ball-launching machines are also known which can be mechanically regulated in height through a screw which can be fastened and arranged along a guide, or by means of an electric motor; moreover, some types of ball-launching machines are equipped with oscillation systems, from a very narrow angle to the full length of the field, which optimize the training, allowing for example an alternate training of straight and backhand shots.

The above ball-launching machines are disclosed, for example, in the following patents: US2002165048 CN104436611, CN102921159, CN201036683.

It is clear how the above ball-launching machines prevent a continuous training by a user; such machines have a containing capacity of about 200-250 balls: after having launched all balls outside, a user is compelled to stop his play and/or training to collect the balls and place them back in the ball-launching machine. Moreover, the transport of known ball-launching machines is not optimum, being it also necessary to transport a tank containing the 200-250 balls. Finally, known ball-launching machines do not allow training and/or playing on any type of field, inside or outside, reducing their usability.

Machines equipped only with the collecting functionality are also known, for example as disclosed in patent DE3242358 related to a system to take back the balls to the ball-launching machines placed at the end of the field, through the use of a vertical curtain equipped with grooves to channel and collect all played balls, which, through suitable channels, go back to one or more ball-launching machines.

Machines are also known which combine both the ball-launching functionality and the ball-collecting functionality; in particular, patent:

CN205252475 discloses a collecting method based on a conveyor roller which conveys the balls towards a chassis equipped with a toothed belt, which manages to take the balls towards the unit which launches them, simulating a play;

CN205252474 discloses a machine with two units, a first fixed unit equipped with a movement sensor, wireless connected to a second mobile unit, such as a robotic art, adapted to collect the balls in a basket placed at the upper end of the chassis. Such basket ends with a duct which conveys to the ball-shooting portion of the machine; and CN101288803 discloses a ball-shooting machine with a net arranged on its top, whose lower end ends with an opening which communicates with the entry of the ball-launching robot.

Known machines do not seem efficient for improving the user training, to not allow regulating the machine depending on a standard playing net, preventing a realistic simulation of the play dynamics; moreover, some of the above described known ball-launching machines note are lacking the basket, preventing the player from using more balls during its training: it follows that there is no management of the launch time between a ball and the other, and it is impossible to play many balls in the circuit simultaneously.

It is clear that there is no ball-launching machine equipped with all functionalities and characteristics necessary to guarantee an optimum training and/or play, simulating a real play dynamics in a field on any physical size and condition, such as, for example, made of clay ground, grass, concrete, or synthetic material, outside or covered, and according to the preparation level or each user.

SUMMARY OF THE INVENTION

Object of the present invention is solving the above prior art problems, by providing an optimized omnidirectional system for expelling and collecting balls.

Another object of the present invention is providing a system for expelling and collecting balls capable of simulating a real play dynamics with racket, and a customized training extended in time.

A further object is providing a ball-launching machine, which allows a user to train or play in an area with any physical size and condition.

A further object of the present invention is providing an operating process of such system for expelling and collecting balls.

The above and other objects and advantages of the invention, as will appear from the following description, are obtained with a system for expelling and collecting balls and its related operating process as claimed in the respective independent claims. Preferred embodiments and non-trivial variations of the present invention are the subject matter of the dependent claims.

It is intended that all enclosed claims are an integral part of the present description.

It will be immediately obvious that numerous variations and modifications (for example related to shape, sizes, arrangements and parts with equivalent functionality) can be made to what is described, without departing from the scope of the invention as appears from the enclosed claims.

BRIEF DESCRIPTION OF THE DRAWINGS

The present invention will be better described by some preferred embodiments thereof, provided as a non-limiting example, with reference to the enclosed drawings, in which.

DETAILED DESCRIPTION OF PREFERRED EMBODIMENTS

Figure 1:
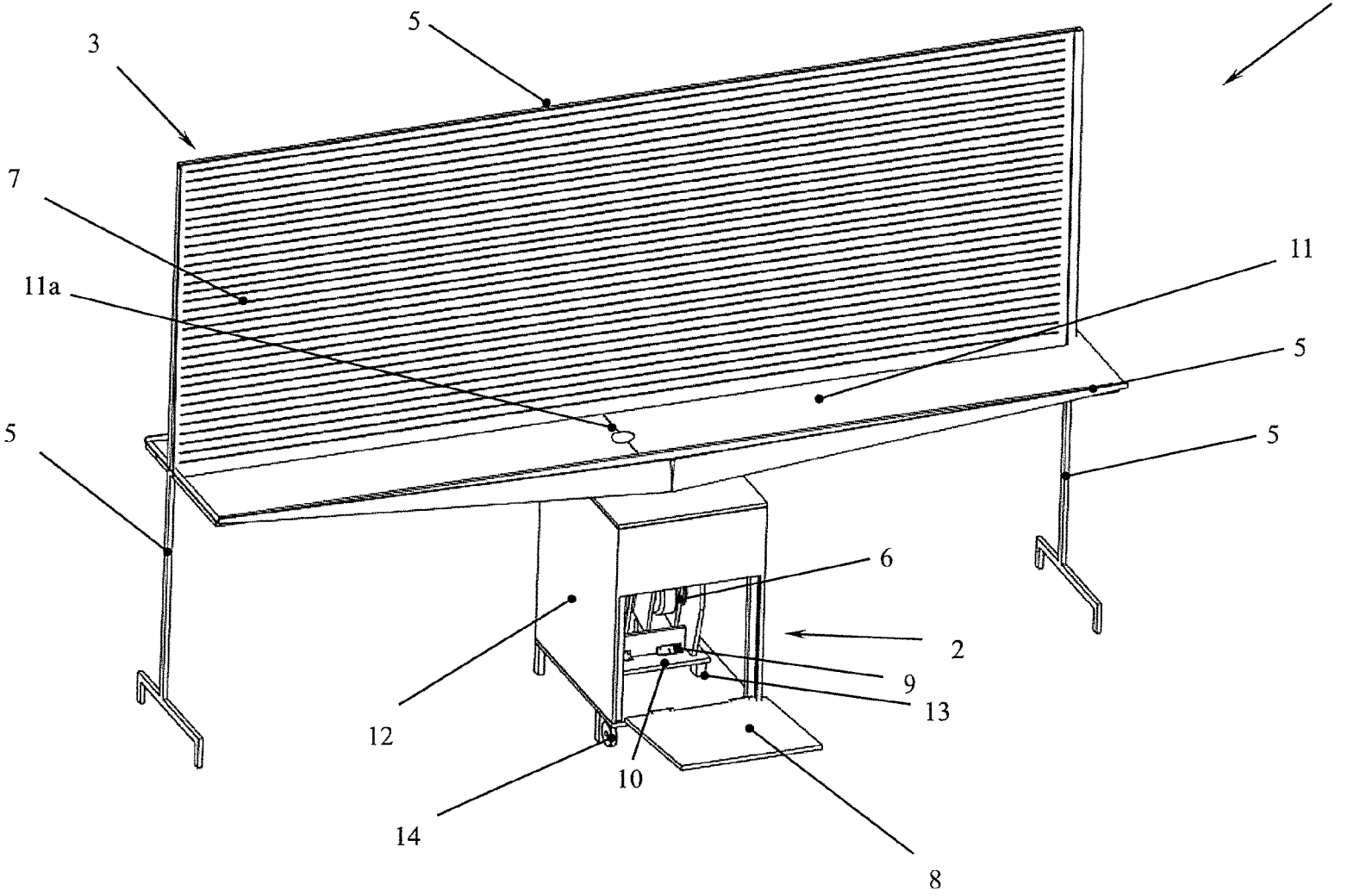
FIG. 1 shows a three-dimensional view of a preferred embodiment of a device for expelling and collecting balls of the system according to the present invention.
Figure 2:
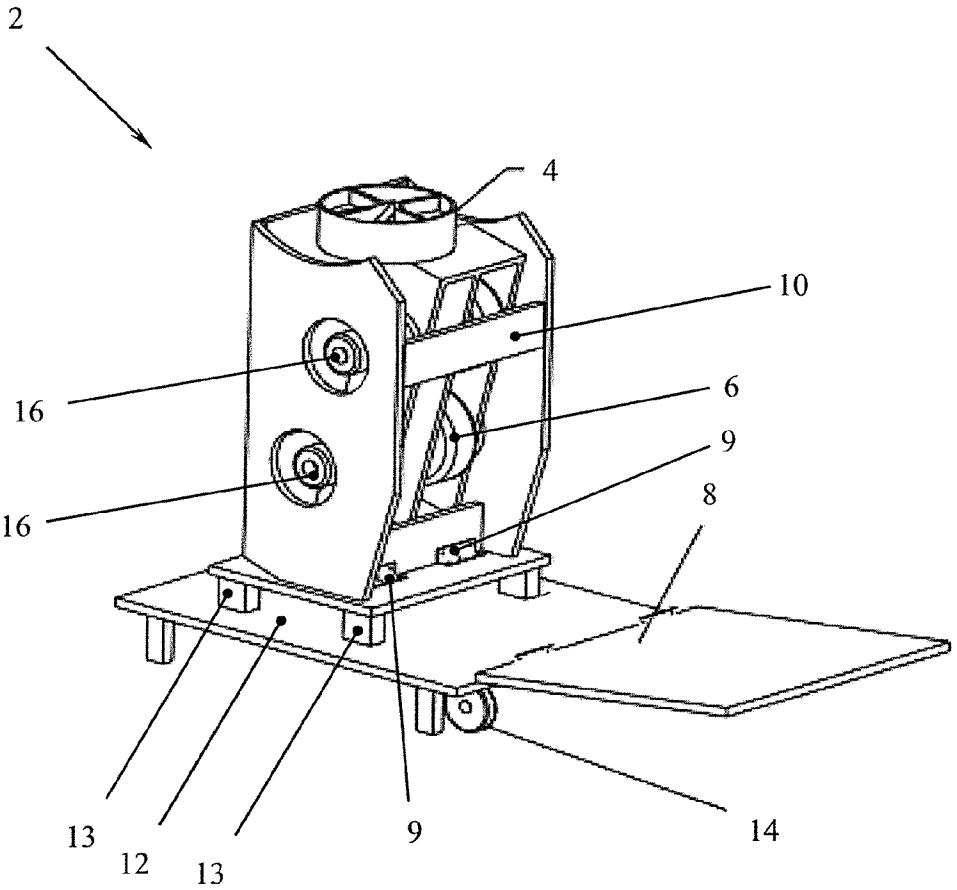
FIG. 2 shows a three-dimensional view of the expelling device balls of the system according to the present invention.

With reference to FIG. 1, the omnidirectional system 1 for expelling and collecting balls, according to the present invention, is equipped with an expelling device 2 and with a collecting element 3 of at least one ball, preferably a tennis ball.

Advantageously, the system 1 for expelling and collecting balls is adapted to reproduce the real dynamics of at least one sports activity with racket, such as for example, tennis, or other similar one, and in particular is adapted to launch at least one ball and to collect the ball, previously expelled and afterwards hit through a racket by at least one user.

The collecting element 3, at the same time adapted to decrease the speed of the ball and to collect the ball inside the expelling device 2, is composed of:

a chassis 5, adapted to support the collecting element 3;

at least one net element 7, adapted to accompany the movement of a ball launched by at least one user, dampening and decreasing the ball speed, preventing its forward bouncing; and at least one channeling means 11, preferably shaped as a pyramid, composed of a soft element such as, for example, a bag, or other similar one, connected on its perimeter to the chassis 5, and equipped at its center with at least one opening 11*a*, adapted to be connected to at least one collecting means 4, such as, for example, a basket or other similar, one, of the expelling device 2, enabling to collect the ball; moreover, such channeling means 11 enable to transport the system allowing an easy closure of the collecting element 3.

Advantageously, the net element 7 is composed of a first net element fastened on its top and side to the chassis 5, and on its bottom not constrained to the chassis 5, and of a second net element placed before the first net element and fastened on its top and side to the chassis 5, and on its bottom to the channeling means 11; moreover, the second net element is equipped with a plurality of sensors adapted to detect technical information, such as, for example, trajectory, speed, etc., of the ball hit by the user, providing information processed by a software system software, useful for managing a customized training program.

The expelling ball-launching device 2 is equipped with:

at least one case 12 equipped on its bottom with a plurality of castor wheels 14 adapted to move the expelling device 2 and equipped on its front with at least one closing element 8, such as, for example, a door or other similar one, and the lower portion of the closing element 8 is connected to the front lower edge of the case 12;

collecting means 4, adapted to be connected to the opening 11*a* of the collecting element 3;

two or more propelling means 6, such as, for example independently actuated rollers, adapted to enable expelling the ball;

a plurality of motors 16, such as for example direct current motors, adapted to manage the propelling means 6, to rotate, and to incline the expelling device 2;

an electric apparatus adapted to electrically and mechanically manage the plurality of motors 16 and propelling means 6, through at least one managing unit, regulating the launching speed of the ball, managing the launch timing of two or more balls, the rotation, the height and the slant of the expelling device 2, allowing the user to intensify or slowing down his training and/or play; and at least one framework 10, adapted to include the collecting means 4, two or more propelling means 6, the plurality of motors 16, and the closing element 8.

Advantageously, the framework 10 is equipped on its bottom with a plurality of mechanical devices 13, such as for example bearings or other similar ones, adapted to enable the rotation of the expelling device 2, and on its front is equipped with at least one constraining means 9, such as, for example, a single or multiple hinge, adapted to enable the clockwise slant of the expelling device 2, through the plurality of motors 16.

In particular, the closing element 8, when using the system 1, is arranged orthogonal to the expelling device 2, when expelling the ball from the expelling device 2 through the propelling means 6, the ball bounces onto the upper surface of the closing element 8 before going towards the user, simulating the real play dynamics, and allowing to use the system 1 and enabling the user to train and/or play in an area with any physical size and condition, such as, for example, made of clay ground, grass, concrete, or synthetic material, outside or covered; moreover, simultaneously regulating manually or from a remote place the slant of the expelling device 2, the impact of the ball onto the upper surface of the closing element 8, and will confer the ball such an attitude as to simulate a volley shot, a semi-volley shot or a counterbalance shot, or a smash or a passing shot along a line, or a crossed passing shot, etc.

Advantageously, it is possible to regulate the height of the expelling device 2, and consequently of the system 1, by arranging the channeling means 11 next to an upper portion of a regulatory game net, in order to really simulate a play dynamics and enabling the user aerobic and reflex training.

The electric apparatus is mainly composed of:

at least one displaying means, such as for example a tactile display or other similar one, arranged on the expelling device 2, adapted to allow the user, in manual mode through a touch-screen, or through a remote control, or in Wi-Fi mode through an application on at least one mobile device, to set a training and/or playing program, regulating inclination and rotation of the expelling device 2 and ball speed, launching timing, etc.;

the managing unit, such as, for example, a programmable logic controller, or other similar one;

a plurality of sensors, such as for example, position sensors or limit sensors, adapted to verify the device movements, proximity sensors adapted to detect the presence of the ball inside the collecting means 4, tachometers adapted to verify the operating speed of the plurality of motors 16, etc.; and a wireless data transmission module, such as, for example Bluetooth, or other similar one; the wireless data transmission module is adapted to manage the expelling device 2 by the user from remote, through a remote control, or through the use of the application on a mobile device, and adapted to manage the communication of two or more expelling and collecting systems 1, allowing a multiple and simultaneous training by two or more users.

The operating process of the expelling and collecting system 1 comprises the following steps:

providing the system 1;

providing the plurality of motors 16 of the electronic apparatus and placing the system 1 depending on the training and/or playing program set by the user, regulating slant, rotation of the expelling device 2 and ball speed, timing interval, etc.;

expelling a first time a ball from the expelling device 2 through the propelling means 6;

beating a first time the ball by the user along the direction of the collecting element 3;

impacting the ball with the net element 7; such impact induces an outwards extension in parallel with the ground of the first net element enabling a dampening of the ball speed and trajectory;

channeling, through the second net element, the ball next to the opening 11*a* enabling its collection;

housing the ball in the collecting means 4;

expelling a second time the ball from the expelling device 2 through the propelling means 6;

beating a second time by the user the ball along the direction of the collecting element 3; and cyclically operating the system 1 till it is voluntarily stopped by the user.

The invention has the following advantages:

it allows a long training also without interruption, since the ball-collecting element of the system allows collecting the balls simultaneously with the training performance;

it allows each system user a customized training depending on sex, age, technical skills, enabling a computerized training management;

it guarantees the training of the system user on any area, both outside and inside, through the ball bouncing on the mobile element of the system, enabling to improve technique and user reflexes;

it allows the system user to launch balls in any direction, since speed, training program, etc., are adjustable by the user;

it allows a real reproduction of a play dynamics, being the expelling device of the system arranged at a height equal to that of an official net; and it enables the transport, since the system is equipped with wheels and is capable of being completely disassembled, and further has minimum overall sizes, not needing a ball dispenser.

I claim:

1. An omnidirectional system for expelling and collecting balls adapted to reproduce a real playing and/or training dynamics, the system being equipped with:

at least one closing element connected to at least one expelling device arranged orthogonal to the expelling device when expelling at least one ball from the system, the ball bouncing on an upper surface of the closing element going towards at least one user;

at least one net element of at least one collecting element, the net element being composed of a first net element fastened on its top and side to a chassis, and on its bottom not constrained to the chassis, and of a second net element placed before the first net element and fastened on its top and side to the chassis, and on its bottom to at least one channeling means;

the at least one channeling means connected on its perimeter to the chassis, and equipped at a center of the channeling means with at least one opening, adapted to be connected to at least one collecting means of the expelling device for collecting the ball, the channeling means further allowing to transport the system by allowing a closure of the collecting element;

wherein the expelling device is equipped with:

at least one case equipped on its bottom with a plurality of castor wheels adapted to move the expelling device, and equipped on its front with the closing element, the lower portion of the closing element being connected to a front lower edge of the case;

the collecting means, adapted to be connected to a recess of the collecting element;

two or more propelling means, adapted to enable expelling the ball;

a plurality of motors, adapted to manage the two or more propelling means, to rotate and to incline the expelling device;

an electric apparatus adapted to electrically and mechanically manage the plurality of motors and the two or more propelling means, through at least one managing unit, regulating a launching speed of the ball, managing a launching timing of two or more balls, a rotation, a height and a slant of the expelling device, allowing the user to perform a different training and/or play by making it quicker or slower; and at least one framework, adapted to include the collecting means, the two or more propelling means, the plurality of motors, the closing element, the framework being equipped on its bottom with a plurality of mechanical devices, adapted to enable the rotation of the expelling device, and on its front being equipped with at least one constraining means adapted to enable a clockwise slant of the expelling device, through the plurality of motors.

2. The system of claim 1, wherein the collecting element is composed of:

a chassis, adapted to support the collecting element;

the net element, adapted to accompany a movement of the ball launched by the user, dampening and decreasing the speed of the ball, preventing its forward bouncing.

3. The system of claim 2, wherein the channeling means are composed of at least one soft element connected on their perimeter to the chassis, and equipped at their center with at least one opening, adapted to be connected to at least one collecting means, of the expelling device.

4. The system of claim 1, wherein the expelling device is adjustable in height, through the plurality of motors, enabling an arrangement of the channeling means next to an upper portion of an official playing net, really simulating the play dynamics and enabling a training of the user.

5. The system of claim 4, wherein the electric apparatus is composed of:

at least one displaying means, arranged on the expelling device, adapted to allow the user, in manual mode through touch-screen, or in W-Fi mode through an application on at least one mobile device, to set at least one training and/or playing program, regulating slant, rotation of the expelling device and speed of the ball, and the launching timing;

the managing unit;

a plurality of sensors; and a wireless data transmission module, adapted to manage the expelling device by the user from at least one remote place, through the use of at least one application on a mobile device, and adapted to manage a communication of two or more of the systems, enabling a multiple and simultaneous training by two or more users.

6. An operating process of the system for expelling and collecting balls of claim 1, the process comprising the following steps:

providing the system;

providing the plurality of motors of the electronic apparatus and placing the system depending on the training and/or playing program set by the user;

expelling a first time the ball from the expelling device through the two or more propelling means;

beating a first time by the user the ball along the direction of the collecting element;

impacting the ball simultaneously with the net element, the impact inducing an outward extension, in parallel with the ground, of the first net element, enabling to dampen speed and trajectory of the ball;

channeling, through the second net element, the ball next to the recess, enabling its collection;

housing the ball in the collecting means;

expelling a second time the ball from the expelling device through the two or more propelling means;

beating a second time by the user the ball along the direction of the collecting element; and cyclically operating the system till a voluntary stop by the user.

* * * * *